United States Patent [19]

Young et al.

[11] Patent Number: 4,574,893

[45] Date of Patent: Mar. 11, 1986

[54] COMPACT POWER SWIVEL

[76] Inventors: Horace J. Young, 1100 Eighth Ave. SW., Suite 2603, Calgary, Alberta, Canada, T2P 3T9; Robert F. Becker, 320 Silver Valley Rise NW., Calgary, Alberta, Canada, T3B 4B1

[21] Appl. No.: 644,263

[22] Filed: Aug. 27, 1984

[51] Int. Cl.[4] ..... E21B 3/02

[52] U.S. Cl. ..... 175/170; 173/163

[58] Field of Search ..... 175/170, 189, 195, 203, 175/161; 173/163

[56] References Cited

U.S. PATENT DOCUMENTS

| | | | |
|---|---|---|---|
| 2,215,928 | 9/1940 | Hornbrook | 175/189 X |
| 2,998,084 | 8/1961 | Johnson et al. | 175/170 X |
| 3,145,786 | 8/1964 | O'Neill et al. | 175/170 X |
| 3,157,236 | 11/1964 | Arthur | 175/170 X |
| 3,670,832 | 6/1972 | Striegler | 175/170 X |
| 3,736,993 | 6/1973 | West | 173/163 |

*Primary Examiner*—Stuart S. Levy
*Assistant Examiner*—Thomas R. Hannon
*Attorney, Agent, or Firm*—Shlesinger, Arkwright, Garvey & Fado

[57] ABSTRACT

A compact power swivel for well drilling rigs and the like, comprising a frame; a mounting bracket secured to the frame; a quill rotatable on an axis mounted to the bracket; a bull gear coaxially disposed on the quill for rotating the quill; a motor mounted to the bracket and including a shaft rotatable on an axis parallel to the quill axis; a spur gear coaxially disposed on the shaft and rotatable, therewith engaging the bull gear for rotating the bull gear and the quill thereby; a disc brake mounted to the bracket and co-operating with the shaft for controlling rotation of the shaft and the quill thereby; and a thrust bearing coaxially disposed on the quill and associated with the bracket, for permitting free rotation of the quill and for distributing to the bracket forces associated with displacement of the swivel.

24 Claims, 6 Drawing Figures

FIG 1
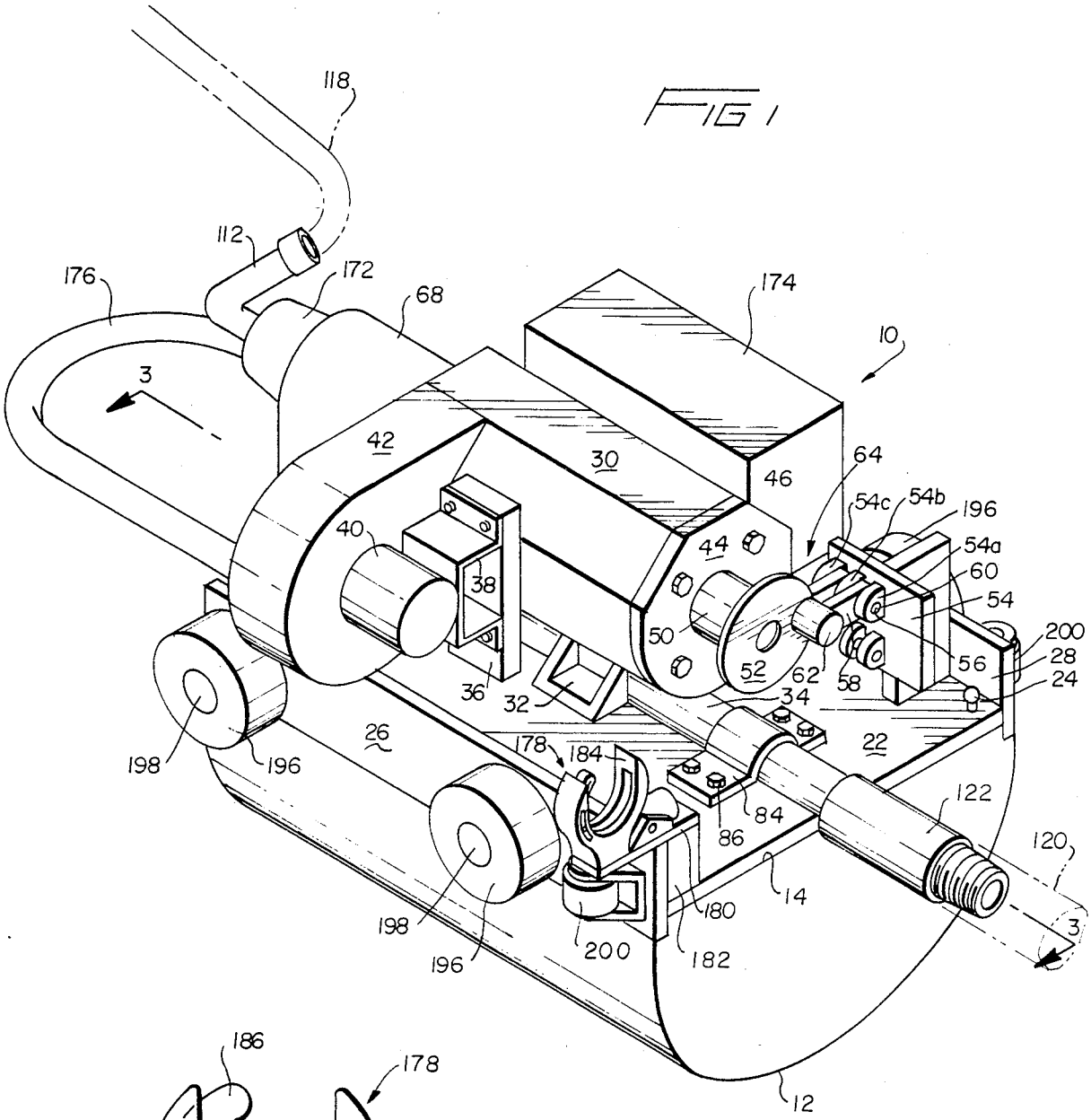
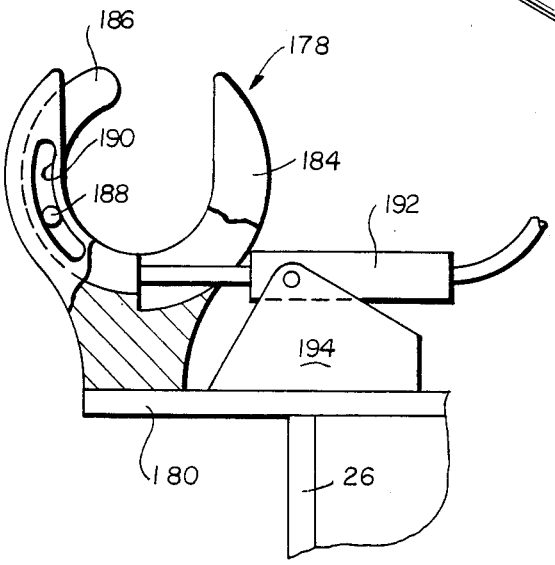
FIG 2

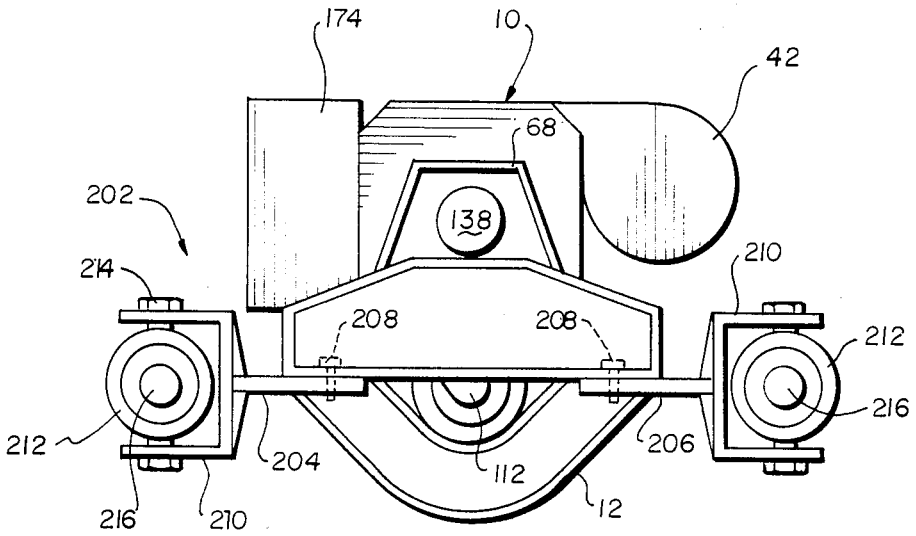
FIG 4
FIG 5
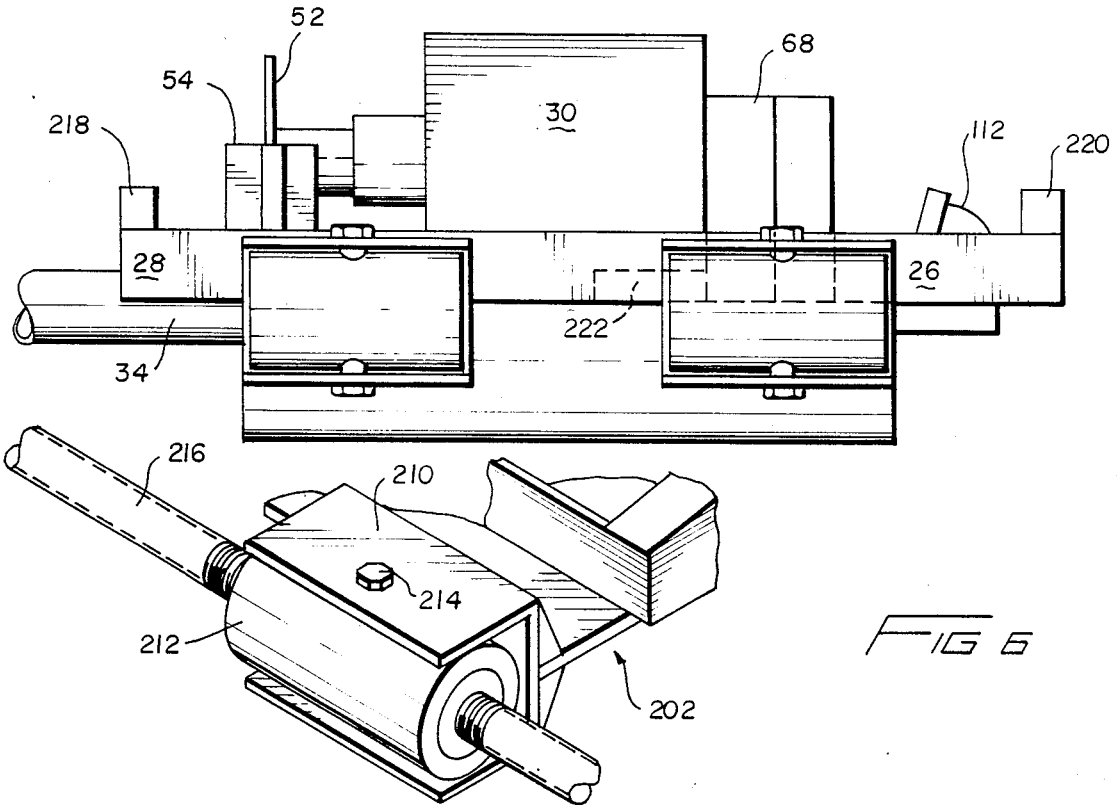
FIG 6

COMPACT POWER SWIVEL

BACKGROUND OF THE INVENTION

The ever increasing search for oil and natural gas, as well as other subterranean deposits, has provided many and varied types of drilling rigs. Conventional drilling rigs utilise what is known in the drilling art as a "Kelly" system for rotation of the drilling bit. Other systems utilize what is commonly referred to as a "spinner", which is attached below a non-powered swivel to rotate a drill bit attached to a plurality of longitudinally coupled lengths of drill pipe in order to form the borehole. The drilling operation further requires means for providing drilling mud to the rotating drill bit in order to cool and lubricate the bit, as well as to remove particulates from the borehole. When a power swivel is utilized as will be defined within this specification, the swivel serves the further function of exerting pressure on the drill bit in order to assist its passage through the subterranean deposits.

Downward pressure exerted on the drill bit by a power swivel causes an associated reverse force to be exerted on the power swivel with the result that the power swivel drive system must be capable of accommodating this force. Furthermore raising of the power swivel and the attached lengths of drill pipe causes a reversely directed force to be applied to the power swivel with the necessity, therefore, of providing means integral with the power swivel, for accommodating these upwardly and downwardly directed forces.

While the power swivel requires means for accommodating the axially directed forces, it is also necessary that the length of the power swivel be minimized in order that a sufficient number of longitudinally coupled lengths of drill pipe may be connected to the power swivel and to those lengths of drill pipe already suspended in the borehole. It should be obvious that as the length of the power swivel increases, then the number of lengths of coupled drill pipe must decrease or the drilling rig mast or derrick height must be increased, which is not desirable. Consequently it is important that the power swivel drive system be as compact as possible in order to allow the maximum number of coupled lengths of drill pipe to be accommodated.

Conventional drilling rigs, particularly vertical drilling rigs, require at least an upper tong to be secured to the mast assembly in order to hold the lengths of drill pipe prior to coupling with the power swivel A means integral with the power swivel for holding the coupled lengths of drill pipe should advantageously effect the efficiency of the overall drilling operation.

A power swivel should be capable of being utilized by vertical drilling rigs as well as drilling rigs which are angularly displaceable around an axis. Such a universal power swivel requires a pressurized lubrication system in order to permit its use at any angle from the horizontal to the vertical.

Efficient creation of a borehole requires precise control over the rotational speed of the advancing drill bit. The speed of the rotating drill bit should be independently controllable relative to the longitudinal displacement of the power swivel.

The present invention provides a compact power swivel having a compact power swivel drive system driven by an electric motor whose rotational speed may be controlled by varying the current supply to the motor. Furthermore, the present invention discloses and claims a unique thrust bearing assembly designed to accommodate the radial and axial forces caused by reciprocal advancement and removal of the power swivel.

The present invention further discloses a disc brake which is utilized to lock the drill strap in a particular, predetermined position. This is necessary for establishing the correct orientation of the tools at the end of the drill string prior to start of drilling procedures, especially with directional drilling. Additionally the present invention discloses a system for providing drilling mud through the power swivel in order to lubricate and cool the drill bit. Finally, the major components of the present power swivel are secured to a removable mounting bracket in order to permit ready replacement of the power swivel components in the event of failure of one of the components, without the necessity of removing the entire power swivel assembly from the drilling rig mast. The present invention therefore overcomes the drawbacks and disadvantages of prior art power swivels and yet provides a compact power swivel adapted for both vertical and angular positioning.

OBJECTS OF THE INVENTION

It is the primary object of the disclosed invention to provide a compact power swivel accommodating the needs and overcoming the disadvantages above listed.

It is an additional object of the disclosed invention to provide a compact power swivel having the major operating parts thereof connected to a replaceable mounting bracket in order to permit ready removal and replacement of the power swivel operating parts without requiring the power swivel to be removed from the drilling rig mast.

Yet an additional object of the disclosed invention is to provide a compact power swivel having coaxial thrust bearings to accommodate and distribute the axially and radially directed forces associated with longitudinal reciprocal displacement of the power swivel.

Yet an additional object of the disclosed invention is to provide a compact power swivel having a compact reliable power swivel drive system.

Still yet an additional object of the disclosed invention is to provide a compact power swivel having a pressurized lubrication system operable whenever the power swivel is operating.

Still yet an additional object of the disclosed invention is to provide a compact power swivel employing electric motor drive means for rotating the power swivel quill assembly, Still yet a further object of the disclosed invention is to provide a compact power swivel having a disc brake system designed to regulate the rotational position of the drill string relative to the required position of the drilling tools for directional drilling.

STill yet another object of the disclosed invention is to provide a structural mounting frame connectable with the drilling rig mast and to which the mounting bracket is removably attached.

Yet a further object of the disclosed invention is to provide a drilling mud supply system coaxial with the quill assembly, in order to provide drilling mud to the drill bit.

Still yet a further object of the disclosed invention is to provide a thrust bearing assembly adapted for distributing the axially directed thrust to the power swivel bracket and frame and to the drilling rig mast.

Yet still a further object of the disclosed invention is to provide a compact power swivel which is adapted for use at any angle from the horizontal to the vertical.

Still an additional object of the disclosed invention is to provide a compact power swivel having a pipe gripper system integral with the power swivel, for gripping a length of drill pipe.

Yet an additional object of the disclosed invention is to provide cooling means for the drive motor.

Yet a further object of the disclosed invention is to provide a compact power swivel having electric motor drive means rotatable on an axis parallel to the drill pipe axis.

Yet still a further object of the disclosed invention is to provide a compact power swivel having a simple gear reduction system.

Yet still another object of the disclosed invention is to provide a compact power swivel assembly having a thrust bearing assembly adapted for minimizing power swivel length.

Yet a further object of the disclosed invention is to provide a compact power swivel having precisely controllable, unusually high RPM available for sharply reducing tool drift and permitting pinpoint targetting of the drill bit.

These and other objects and advantages of the invention will be readily apparent in view of the following description and drawings of the above described invention.

DESCRIPTION OF THE DRAWINGS

The above and other objects, advantages and novel features of the present invention will become apparent from the following detailed description of the preferred embodiment of the invention illustrated in the accompanying drawings, wherein:

FIG. 1 is a perspective view with connections to the wall pipe and fluid supply shown in phantom of our new power swivel;

FIG. 2 is an enlarged front fragmentary elevational view of the pipe gripper assembly of our power swivel with portions broken away;

FIG. 4 is a rear elevational view of another embodiment of our power swivel disclosing means for longitudinally advancing the power swivel;

FIG. 5 is a side elevational view of the power swivel of FIG. 4; and

FIG. 6 is an enlarged fragmentary perspective view of the power swivel advancement means.

DESCRIPTION OF THE INVENTION

Figure 3:
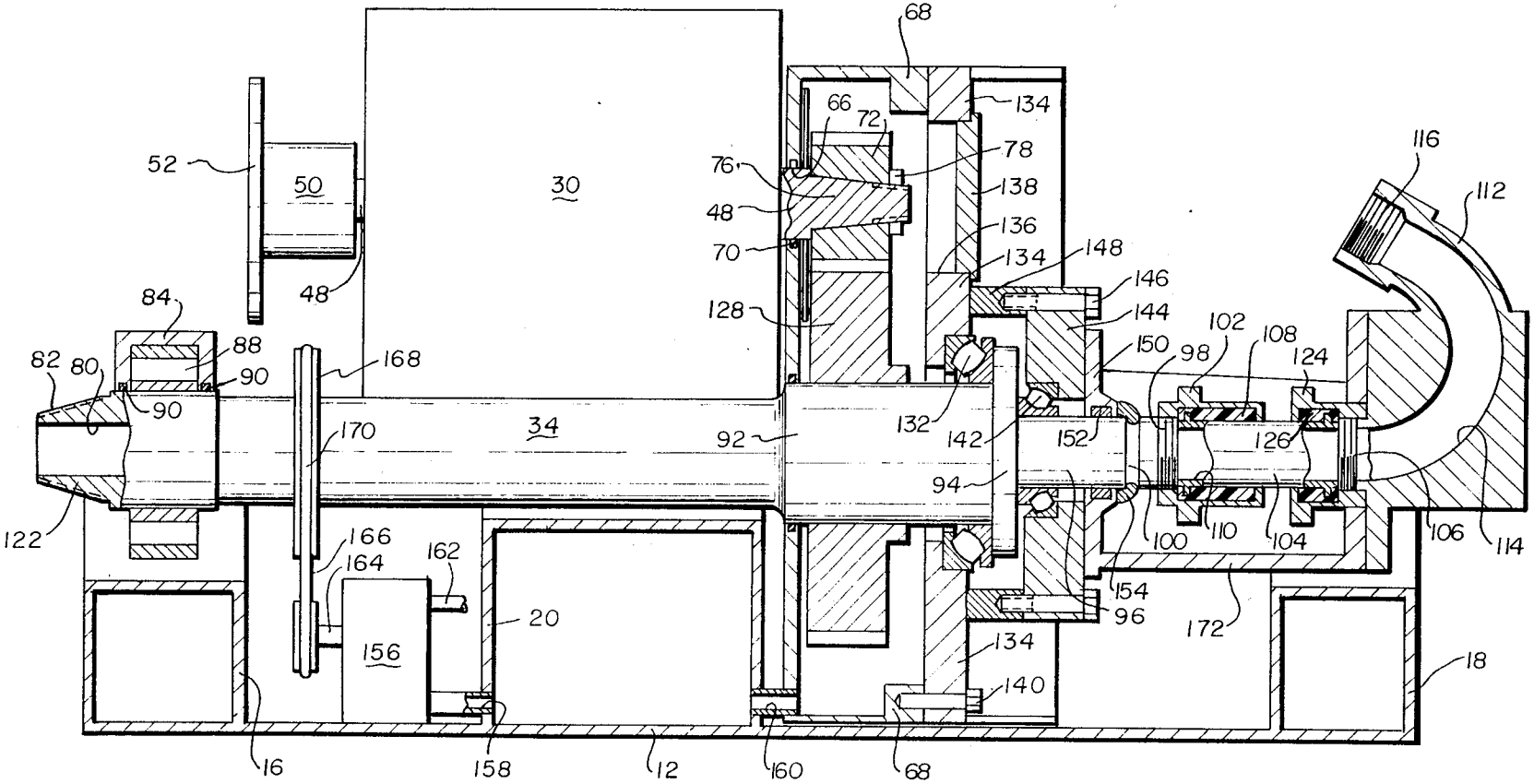
FIG. 3 is a cross-sectional view taken along the section 3—3 of FIG. 1 and with portions broken away.

As best shown in FIG. 1, a power swivel 10 includes a generally U-shaped longitudinally extending frame which is closed at its ends. Frame 12 terminates in an upper generally horizontal plane 14. As best shown in FIG. 3 frame 12 includes spaced generally rectangular structural members or tubes 16 and 18 at the front and back end respectively of frame 12. A generally rectangular structural housing 20 is positioned intermediate structural members 16 and 18 and adds strength and rigidity to frame 12, while also serving as a lubrication reservoir for reasons explained herein later.

As best shown in FIG. 1 a generally horizontal planar mounting bracket 22 is secured to upper frame 12, preferably by bolts 24 in order that mounting bracket 22 is removably secured to frame 12, for reasons to be explained later. Mounting bracket 22 includes spaced parallel members 26 and 28 which extend longitudinally and upwardly generally transverse of mounting bracket 22 and which are secured to mounting bracket 22 by welding or other suitable means.

Motor 30 which is preferably of the direct current electrical type is secured to mounting bracket 22 by spaced mounts 32 disposed on either side of rotating shaft, or quill 34, although only one of base mounts 32 is shown in FIG. 1. Bracket 36 is secured to mounting bracket 22 adjacent motor 30 and includes a mounting member 38 to which motor cooling means 40 (preferably a forced air circulation fan) is connected by duct 42 communicating with motor 30 in order to cool motor 30 and to pressurize motor 30 to inhibit ingress of dirt or other particulates.

Motor 30 is closed at its front end by plate 44 which is bolted by bolts 46 to motor 30, as best shown in FIG. 1, and shaft 48 as best shown in FIG. 3 extends a distance therefrom. Disc 50 is mounted to shaft 48 and includes flange disc 52 rotatable therewith and having a plane of rotation generally transverse of the longitudinal axis of shaft 48.

Mounting bracket 54 extends upwardly from mounting bracket 22 adjacent disc 50 and includes co-operating mounts 54*a*, 54*b* and 54*c* each having an aligned aperture 56. Two arms 58 are pivotably disposed on pins 60 extending through aligned apertures 56 and mount 54*b* is disposed between arms 58. Braking elements 62 are secured to the outermost end of arms 58 and are disposed adjacent the inner and outer surface of flange disc 52. Consequently, arms 58 and braking elements 62 co-operate with flange disc 52 in order to form a caliper disc brake system 64, as is well known in the art. The disc brake system 64 permits precise control over the rotation and the stopping of rotating shaft 48 of motor 30 by the inward and outward reciprocal co-operating motion of braking elements 62 acting on disc flange 52.

As best shown in FIG. 3, the rear end of shaft 48 extends some distance from motor 30 through an aperture 66 in housing 68. Preferably aperture 66 includes a seal 70 in order to seal shaft 48 in housing 68. A spur gear 72 is mounted tightly, in the manner of "fricton" fit, to tapered shaft 48. Lock nut 78 is provided to securely mount spur gear 72 to thin portion 76.

Rotating shaft 34 as best shown in FIG. 3, includes a central aperture 80 having a flaring threaded discharge end 82 adjacent the front end of frame 12. Outboard bearing bracket 84 is bolted to mounting bracket 22 by bolts 86 as best shown in FIG. 1. Outboard bearing 88 is mounted to shaft 34 in outboard bearing bracket 84 and facilitates rotation of shaft 34. Preferably, seals 90 seal outboard bearing bracket 84 to shaft 34 and prevent the entrance of dirt into outboard bearing 88.

Shaft 34 includes a larger diameter portion 92 at generally the rear end of motor 30, adjacent to thin portion 96, and a flange 94 is coaxially secured to larger diameter portion 92 at the rearmost portion thereof. Flange 94 has a plane of rotation generally transverse of the longitudinal axis of shaft 34. Thinner diameter portion 96 is coaxially secured and aligned to flange 94 and extends rearwardly therefrom and terminates in a threaded portion 98. Thinner portion 96 includes a groove 100 for reasons to be explained later. Attachment nut 102 threadedly engages threaded portion 98 and wash pipe 104 is mounted therein and extends rearwardly to threaded portion 106. Packing 108 is disposed in attachment nut 102 around wash pipe 104 and seals the connection of wash pipe 104 to threaded portion 98. It should be noted that wash pipe 104 includes a central aperture 110 coaxial with the aperture 80 of shaft 34.

Gooseneck 112 and aperture 114 curve generally approximately 150° from the central axis of shaft 34. Gooseneck 112 includes threaded portion 116 of aperture 114 in order that mud supply line 118, as shown in phantom lines in FIG. 1, may be connected to threaded portion 116 to feed drilling mud to drill pipe 120 connected to quill 122 at the front portion of shaft 34, as best shown in FIG. 1. In this way a supply of drilling mud may be communicated from hose 118 to drill pipe 120 and flow through shaft 34 by means of gooseneck 112 and wash pipe 104. Preferably attachment nut 124 and packing 126 are disposed around threaded portion 106 in order to prevent the leakage of drilling mud through the connection of gooseneck 112 to wash pipe 104.

As best shown in FIG. 3, bull gear 128 is mounted to larger diameter portion 92 of shaft 34 adjacent spur gear 72 in order that bull gear 128 may engage spur gear 72 so that rotation of spur gear 72 by shaft 48 of motor 30 will cause rotation of shaft 34. In this way a drive system, gears 72 and 128 for rotating shaft 34, by means of motor 30, through a simple compact spur and bull gear arrangement without requiring complicated gear reduction units, is disclosed. This spur gear 72 and bull gear 128 drive system is compact and requires few parts and permits the overall length of power swivel 10 to be kept as short as possible in order that a maximum number of lengths of drill pipe 120 may be used in a drilling rig 12 shown.

The thrust bearing assembly to be described more structurally hereafter not only takes the axial thrust as previously mentioned but the main thrust bearing simultaneously takes the radial thrust from the spur gear assembly. The spur gear 72 tends to throw the bull gear 128 away from itself, in other words the motor and the quill want to part and this action has to be resisted. There are two reasons why a spherical roller bearing is preferred:

1. In most converted non-powered swivels roller bearings are used which cannot take the side thrust or the radial thrust imposed by a spur gear.

2. The spherical roller bearing however, inherently has a self-aligning feature. In other words the axis of rotation of the quill t does not have to be exactly perpendicular to the thrust plane of the bearing. This enables the motor quill and bearing to be dis-assembled in the field and put back together without a critical alignment problem. This is enhanced in the present invention by the use of a particular three bearing arrangment where the upper thrust bearing which loads the main quill bearing floats radially in the bearing holder.

This inner thrust bearing 132 1s a spherical roller and it will be appreciated that not only can it resist thrust from pinion gear 72 against bull gear 128, it can also self-align and still take the thrust which is imposed by a pull on quill 34, or the radial side thrust on the pinion gear. Structurally, bearing 132 is coaxially mounted to larger diameter portion 92 adjacent flange 94 and is disposed in keeper or bearing housing 134. Keeper 134 includes an aperture 136 which is closed by cover 138 and prevents ingress of dirt and other contaminants to housing 68 and drive system 72 and 128. Preferably, keeper 134 is bolted by bolts 140 to housing 68 in order that the withdrawal force may be distributed to housing 68. Outer, radially floating thrust bearing 142 is coaxially mounted to thinner portion 96 adjacent flange 94 and is disposed in cap 144 which is bolted by bolts 146 to secured housing 148 which is secured by welding or the like to keeper 134. In this way the relative alginment and distance between inner bearing 132 and outer bearing 142 may be maintained.

Swivel bonnet 150 is coaxially mounted to thinner portion 96 and to cap 144 and includes seal 152 coaxially mounted to thinner portion 96. Swivel seal 154 is coaxially mounted to thinner portion 96 adjacent swivel bonnet 150 and co-operates with groove 100 in order that the bearings 132 and 142 will be sealed from dirt or other contaminants. In this way the drive system 72 and 128, mounted in housing 68 and the bearing system 132 and 142, mounted in housing 134, are protected from contamination and thereby prolong the service life of power swivel 10.

Lubrication pump 156 communicates with reservoir 20 by means of duct 158. Similarly duct 160 communicates with drive system housing 68 in order that lubrication contained in housing 68 and bearing assemblies 132 and 142 closed by cap 144, may be stored in reservoir 20 and may be pumped back into housing 68 and bearing housing cap 144. Pump 156 includes an output duct 162 which supplies pressurized lubricant to drive system housing 68 and bearing housing cap 144. In this way power swivel 10 may be utilized at any angle from the horizontal to the vertical without the concern that a supply of lubrication will not be available to the drive system or to the bearings.

Pump 156 includes drive shaft 164 to which pulley 156 is affixed. An additional pulley 168 is mounted to shaft 34 adjacent pulley 166 and belt 170 rotationally encompasses pulleys 168 and 166. Rotation of shaft 34 causes rotation of shaft 164 so that lubricant will be pumped from housing 20 through duct I58 to pump 156 and from there through duct 162 to drive housing 68 and bearing housing 144. In this way whenever the power swivel 10 and its rotating shaft 34 are operating, a supply of pressurized lubricant is always available for the bearings 132 and 142 and for the gears 72 and 128. It should be noted that the reservoir 20 is a structural component adding strength and rigidity to frame 12. Reservoir 20 is positioned below motor 30 and pump 156 is closely adjacent thereto in order that pulleys 166 and 168 may be positioned below disc 50. This permits the overall length of power swivel 10 to be minimized while still permitting efficient operation of the power swivel 10. Preferable a cover 172 is coaxially mounted around wash pipe 104 between gooseneck 112 and swivel bonnet 150, in order to further prevent ingress of dirt and other contaminants.

As best shown in FIG. 1 an electric junction box 174 is disposed adjacent motor 130 and mounted to mounting bracket 22 in order to supply electrical power from a source (not shown) to motor 30, by means well known in the art.

It should be obvious that all of the major working components of power swivel 10 including motor 30, shaft 34, brake assembly 64, bearing housing 68 and gooseneck 112, are fastened to mounting bracket 22 and that should any one of those components fail, then removal of bolts 24 permits all of the major components thereof to be removed as one unit, without the need that the power swivel 10 be removed from the drilling rig (not shown). This feature greatly facilitates utilization of the power swivel 10 as prior art power swivels have required disassembly of the components and removal of the power swivel 10 from the drilling rig, whenever one of the components should fail, particularly one of the major components such as the drive system or the bearing assembly. Consequently, the described power swivel 10 provides a compact unit which permits several lengths of standard pipe to be assembled above ground in a short drill rig.

As best shown in FIG. 1, a pipe gripping assembly 178 is mounted to plate 180 secured to member 26 and block 182. Pipe gripping assembly 178, as best shown in FIG. 2, includes a generally U-shaped pipe gripping member 184 in which a pipe gripping claw 186 is movably mounted and guided by pin 188 co-operating with slot 190 in member 184. A cylinder and piston assembly 192 is pivotably mounted on mount 194 and is connected to pipe gripping claw 186 in order to reciprocally displace pipe gripping claw 186 inwardly and outwardly from an open, to pipe gripped, position. In this way a length of drill pipe such as drill pipe 120 may be gripped by power swivel 10 when the power swivel 10 is suspended by bail 176, from a travelling block (not shown).

As best shown in FIG. 1, roller assemblies 196 are rotatably mounted on pins 198 secured to members 26 and 28, and are adapted for guiding power swivel 10 as it is reciprocally displaced outwardly and downwardly on bail 176 in a vertical drilling rig. Additionally roller guides 200 extend outwardly from members 26 and 28 in order to prevent jamming of rollers 196 during displacement of power swivel 10.

FIGS. 4 THROUGH 6

A separate embodiment of the mounting means for power swivel 10 is disclosed in FIGS. 4 through 6. A carriage 202 includes outwardly extending members 204 and 206, bolted by bolts 208 to frame 12. Receivers 210 are generally U-shaped and mounted to the outer end of members 204 and 206. Threaded shafts 216 cooperate with roller nuts 212 and rotation shafts 216 causes longitudinal displacement of power swivel 10 along shafts 216. In this way the power swivel 10 may be reciprocally displaced while drilling a borehole. Bull or roll nut assemblies 212 and threaded shafts 216 are well known in the art and no further discussion of them is necessary; however, as will be appreciated, the nut and screw drive could be replaced by a rack and pinion, without detracting from the scope and utility of the present invention.

Front and back members 218 and 220 respectively, are secured to mounting bracket 22 at the front and back end respectively of power swivel 10 and prevent the blocking of the movement of power swivel 10 as it is longitudinally displaced by a roll nut or ball nut assembly 212 and threaded shaft 216.

As best shown in phantom line in FIG. 5, thrust block 222 is secured to mounting bracket 22 adjacent drive assembly housing 68 and is adapted for distributing the axially directed forces caused by rearward displacement of power swivel 10 to the mounting bracket 22 and hence to frame 12. In this way rearward displacement of power swivel 10, whether by ball nut assembly 212 or by bail 176, allows the axially directed forces bearing on inner thrust bearing 132 to be distributed to the frame 12 and the mounting bracket 22 to prevent longitudinal displacement of shaft 34. Similarly forward displacement of power swivel 10 causes the axially directed forces operating against outer thrust bearing 142 to be distributed through cap 144 to bearing assembly housing 134 and hence to drive assembly housing 68, so that it may be distributed to thrust block 222 and to bracket 22 as well as to frame 12. In this way the axially directed forces attributable to the forward displacement of power swivel 10, particularly when drill pipe 120 is affixed to quill 122, prevents longitudinal rearward displacement of shaft 34. Additionally, flange 94 cooperates with bearings 132 and 142 to prevent displacement of shaft 34. Consequently it can be seen that the compact power swivel 10 not only provides a compact drive assembly but also a compact highly efficient thrust bearing assembly for distributing radially and axially directed forces attributable to longitudinal displacement of power swivel 10. This compact thrust bearing assembly, represented by inner thrust bearing 132 and outer thrust bearing 142, as well as the compact drive assembly with spur gear 72 and bull gear 128, permits power swivel 10 to have minimum length while still being capable of providing the torque and forces necessary for accurate drilling of a borehole.

For example, a power swivel 10, constructed as in FIGS. 1 through 6, may have a 650 horsepower motor 30 capable of generating 20,000 ft-lbs of torque while permitting accurately controlled rotational speeds anywhere from 0 to 300 rpm. However a higher, 1000 hp motor may also be used as a main drive. The swivel 10 is capable of applying a force of 100 tons during the frontal displacement thereof and has a pulling force of as much as 300 tons during rearward displacement. This compact power swivel permits precisely controlled, unusually high rpm while greatly reducing tool drift and permitting pinpoint targetting. The pressurized lubrication system greatly extends the bearing and gear life and thereby provides long, reliable service life, with minimum parts, for maximum efficiency.

While this invention has been described as having a preferred design, it is understood that it is capable of further modification, uses and/or adaptations of the invention following in general the principle of the invention and including such departures from the present disclosure as come within known or customary practice in the art to which the invention pertains and as may be applied to the central features herein before set forth, and fall within the scope of the invention of the limits of the appended claims.

We claim:

1. A compact displaceable power swivel for well drilling rigs and the like, comprising:

(a) a frame;

(b) mounting bracket means secured to said frame;

(c) quill means rotatable on an axis mounted to said bracket means;

(d) bull gear means coaxially disposed on said quill means for rotating said quill means;

(e) motor means mounted to said bracket means and including a shaft rotatable on an axis parallel to said quill means axis;

(f) spur gear means coaxially disposed on said shaft and rotatable therewith engaging said bull gear means for rotating said bull gear means and said quill means thereby;

(g) disc brake means mounted to said bracket means and cooperating with said shaft for controlling rotation of said shaft and said quill means thereby; and (h) thrust bearing means coaxially disposed on said quill means and associated with said bracket means for permitting free rotation of said quill means and for distributing to said bracket means forces associated with displacement of said swivel.

2. The swivel as defined in claim 1 wherein:
(a) said mounting bracket means is removably secured to said frame.

3. The swivel as defined in claim 2 wherein:
(a) said spur gear means is disposed on a first end of said shaft; and
(b) said disc brake means co-operates with a second end of said shaft spaced from said first end.

4. The swivel as defined in claim 3 wherein:
(a) said disc brake means includes:
i. a disc mounted to said second end and rotatable therewith.
ii. a bracket secured to said mounting bracket adjacent said disc; and
iii. caliper means mounted to said bracket for releaseably engaging said disc for controlling rotation of said disc thereby.

5. The swivel as defined in claim 3 wherein:
(a) said thrust bearing means includes:
i. an inner bearing assembly generaly adjacent said bull gear means; and
ii. a floating outer bearing assembly spaced from said inner bearing assembly.

6. The swivel as defined in claim 5, further comprising:
(a) outboard bearing means coaxially disposed on said quill means.

7. The swivel as defined in claim 1 further comprising:
(a) a lubrication reservoir integral with said frame, positioned generally adjacent said motor means; and
(b) pump means in fluid communication with said reservoir and said thrust bearing means secured to said frame and operatively associated with said quill means for distributing lubricant in said reservoir to said thrust bearing means.

8. The swivel as defined in claim 7 wherein:
(a) said thrust bearing means, said bull gear means and said spur gear means are positioned in a housing; and
(b) drainage means in said housing in fluid communication with said reservoir for providing lubricant thereto.

9. The swivel as defined in claim 8 wherein:
(a) said outer thrust bearing means is disposed in cap means and coaxially disposed around said quill means;
(b) said inner thrust bearing means is disposed in holder means for being coaxially disposed around said quill means; and
(c) said cap means secured to said holder means.

10. The swivel as defined in claim 9 wherein:
(a) said quill means includes a thickened diameter portion for mounting said bull gear means and said inner thrust bearing means;
(b) said quill means includes a thinner diameter portion for mounting said outer thrust bearing means and said seal means; and
(c) said quill means includes a radially extending flange disposed between said thickened portion and said thinner portion for maintaining longitudinal positioning of said outer and inner thrust bearings.

11. The swivel as defined in claim 8 further comprising:
(a) thrust block means secured to said mounting bracket and connected to said housing for transmitting forces to said mounting bracket during displacement of said power swivel.

12. The swivel as defined in claim 7 wherein:
(a) said pump means includes belt drive means circumferentially mounted to said quill means and drivingly connected to said pump means for driving said pump during rotation of said quill means.

13. The swivel as defined in claim 1 and wherein:
(a) said quill means includes a longitudinally extending aperture; and
(b) gooseneck means in fluid communication with said quill means aperature for supplying fluid thereto.

14. The swivel as defined in claim 13 wherein:
(a) seal means sealing said quill means and said gooseneck means prevents leakage of fluid therefrom.

15. The swivel as defined in claim 1 wherein:
(a) said motor means includes a DC motor.

16. The swivel as defined in claim 1 wherein:
(a) said motor means includes a variable speed AC motor.

17. The swivel as defined in claim 1 further comprising:
(a) claw means secured to said mounting bracket for gripping an article; and
(b) said claw means having a centre line of grip parallel to said quill means axis.

18. The swivel as defined in claim 17 wherein:
(a) said claw means includes a movable gripper element; and
(b) cylinder and piston means mounted to said mounting bracket and connected to said gripper element for moving said gripper element.

19. The swivel as defined in claim 17 further comprising:
(a) roller means rotatably secured to said mounting bracket for guiding said swivel during displacement thereof.

20. The swivel as defined in claim 17 further comprising:
(a) bai1 means secured to said frame and extending therefrom for engaging a hook for displacing said power swivel thereby.

21. The swivel as defined in claim 1 further comprising:
(a) blower means in fluid communication with said motor means for cooling said motor means; and
(b) said blower means having an axis of rotation parallel to said shaft axis.

22. The swivel as defined in claim 1 further comprising:
(a) carriage means extending generally outwardly from said frame and connected to said mounting bracket; and
(b) guide means mounted to said carriage means for guiding displacement of said power swivel during displacement thereof.

23. The swivel as defined in claim 22 wherein:
(a) said guide means includes at least a first ball nut assembly operable by ball screws for displacing said swivel.

24. A compact power swivel for well drilling rigs and the like, comprising:
(a) a lower longitudinally extending frame
(b) an upper generally planar longitudinally extending mounting bracket secured to said frame;

(c) motor means secured to said mounting bracket and including rotatable shaft means extending therefrom;

(d) quill means rotatably secured to said mounting bracket and having an axis of rotation parallel to said shaft, said quill means being positioned below said motor means;

(e) first drive means coaxially mounted to a first end of said shaft;

(f) second drive means coaxially mounted to said quill means engaging said first drive means for being rotated thereby;

(g) thrust bearing means coaxially mounted to said quill means adjacent said second drive means;

(h) said quill means including a longitudinally extending aperture;

(i) means secured to said quill means generally adjacent said thrust bearing means for providing fluid to said aperture;

(j) brake means operatively associated with a second end of said shaft for controlling rotation of said shaft and said quill means thereby, said second end being spaced from said first end;

(k) reservoir means integral with said frame adjacent to and below said motor means for holding lubrication therein;

(l) pump means mounted to said frame adjacent said reservoir opposite said drive means and below said motor means for pumping lubricant from said reservoir to said thrust bearing means;

(m) said pump means including pump drive means operatively connected to said quill means for being driven thereby during rotation of said quill means, said pump drive means being below and generally adjacent said brake means; and (n) outboard bearing means coaxially mounted to said quill means adjacent said pump drive means for permitting free rotation of said quill means.

* * * * *